US007807047B2

(12) United States Patent
Randal et al.

(10) Patent No.: US 7,807,047 B2
(45) Date of Patent: Oct. 5, 2010

(54) RECONDITIONING PROCESS FOR USED HYDROCARBON BASED STIMULATION FLUID

(75) Inventors: Chad Randal, Cochrane (CA); Larry Medhurst, Grande Prairie (CA); Doug Hildebrandt, Airdrie (CA)

(73) Assignee: Gibson Energy ULC, Calgary (CA)

( * ) Notice: Subject to any disclaimer, the term of this patent is extended or adjusted under 35 U.S.C. 154(b) by 474 days.

(21) Appl. No.: 11/941,902

(22) Filed: Nov. 16, 2007

(65) Prior Publication Data

US 2008/0119674 A1 May 22, 2008

Related U.S. Application Data

(60) Provisional application No. 60/866,131, filed on Nov. 16, 2006.

(51) Int. Cl.
*C10M 175/00* (2006.01)

(52) U.S. Cl. ..... 208/179; 208/182; 208/184; 208/187; 208/186; 208/347

(58) Field of Classification Search ..... 208/179, 208/182, 184, 187, 186, 347
See application file for complete search history.

(56) References Cited

U.S. PATENT DOCUMENTS

| | | | | |
|---|---|---|---|---|
| 5,242,587 | A * | 9/1993 | Barrington et al. | 210/223 |
| 5,731,392 | A * | 3/1998 | Ali et al. | 526/74 |
| 6,576,107 | B2 * | 6/2003 | Thompson | 204/572 |
| 2003/0015473 | A1 | 1/2003 | Murphy et al. | |
| 2006/0131247 | A1 | 6/2006 | Browne et al. | |

FOREIGN PATENT DOCUMENTS

| | | |
|---|---|---|
| CA | 2435344 | 7/2003 |
| CA | 2182657 | 2/2007 |
| WO | 0134295 | 5/2001 |
| WO | 03076344 | 9/2003 |

* cited by examiner

*Primary Examiner*—Tam M Nguyen
(74) *Attorney, Agent, or Firm*—Sean W Goodwin; Linda M Thompson

(57) ABSTRACT

A process treats a fluid stream of used fracturing fluid containing contaminants and forms a reconditioned fluid stream. Contaminants are removed by the combination of distillation, electrostatic agglomeration, decanting, and filtration. Optionally, the filtered fluid stream is treated in a clay tower to remove residual contaminants.

18 Claims, 9 Drawing Sheets

RECONDITIONING PROCESS FOR USED HYDROCARBON BASED STIMULATION FLUID

CROSS REFERENCE TO RELATED APPLICATION

This application is a regular application claiming priority of U.S. Provisional Patent application Ser. No. 60/866,131, filed on Nov. 16, 2006, the entirety of which is incorporated herein by reference.

FIELD OF THE INVENTION

Embodiments of the invention relate generally to the reconditioning of used hydrocarbon based stimulation fluids and more particularly to removal of contaminants therefrom.

BACKGROUND OF THE INVENTION

Stimulation fluids, such as hydrocarbon-based fracturing fluids are used to treat formations by introducing the fluid into the formation, typically using specialized tools, through a wellbore.

In the case of fracturing fluids, the fluids are typically designed to carry a proppant, such as sand, which is deposited in fractures in the formation produced as a result of hydraulic fracturing with the fluid. The proppant maintains the fracture through which formation hydrocarbons are produced to the wellbore.

Additives are generally added to a hydrocarbon-base fluid to create a fracturing fluid having an increased viscosity so that sufficient proppant can be carried into the fractures. In most cases the increase in viscosity or gelling is reversible, such as through the use of breakers which can be time delayed or activated such as by a change in pH or the like.

At least a portion of the fracturing fluid is produced from the wellbore and generally contains a variety of contaminants carried therein from the formation and the wellbore. The contaminants may include, but are not limited to water, hydrocarbons, such as $C_1$-$C_6$ light hydrocarbons, $C_{20}$ and greater hydrocarbons, gelling additives and other contaminants, such as organometals and the like.

There is interest in the industry in recycling at least the hydrocarbon, base fluid produced from the wellbore, such as through removal of the contaminants therein to permit reuse of the hydrocarbon base fluid in a variety of different uses, including the preparation of new fracturing fluid.

SUMMARY OF THE INVENTION

A process treats a fluid stream of used fracturing fluids containing contaminants and forms a reconditioned fluid stream. Embodiments of the invention permit reconditioning of fluid streams having a wide variety of undesirable characteristics. Embodiments of the invention enable efficiencies in the production of a vendible reconditioned fluid stream including energy use, resource conservation and regeneration of treatment materials. The process can remove phosphorous, including volatile phosphorous, heavy hydrocarbons and organometals as well as water and light hydrocarbons. The reconditioned fluid stream has a low vapor pressure enabling safe storage and handling.

In one broad aspect, a process is provided for treating a fluid stream of used fracturing fluid containing contaminants, including one or more of light hydrocarbons and water, for forming a reconditioned fluid stream, the process comprising:

distilling the fluid stream for removing the one or more of the light hydrocarbons and water, such as through atomization and flashing, so as to form a distilled fluid stream; applying an electrostatic field to the distilled fluid stream for positively and negatively charging contaminants in the distilled fluid stream for forming a charged fluid stream; retaining the charged fluid stream for agglomerating at least a portion of the charged contaminants for forming agglomerates therein; and filtering the charged fluid stream for removing at least the agglomerates for forming a filtered fluid stream as the reconditioned fluid stream. The filtered fluid stream can be treated by clay towers, such as towers packed using attapulgite clay.

DETAILED DESCRIPTION OF THE PREFERRED EMBODIMENT

Processes according to embodiments of the invention permit removal of sufficient contaminants from returned, spent or used fracturing fluids so as to provide a commercially viable hydrocarbon product stream or reconditioned fluid. The used fracturing fluid typically comprises, but is not limited to, a base hydrocarbon fluid, chemicals including gellants and formation-derived contaminants such as light hydrocarbons, typically $C_1$-$C_7$, heavy hydrocarbons being $C_{20}$ or greater and other unwanted impurities, as organometals, phosphorus containing impurities, including volatile phosphorus. The final product stream comprises at least the base hydrocarbon fluid from which the fracturing fluid was initially formed.

Embodiments of the invention comprise operations in a batch mode wherein the used fracturing fluid is treated batch by batch. Other embodiments include operation in a continuous flow process.

Figure 1:
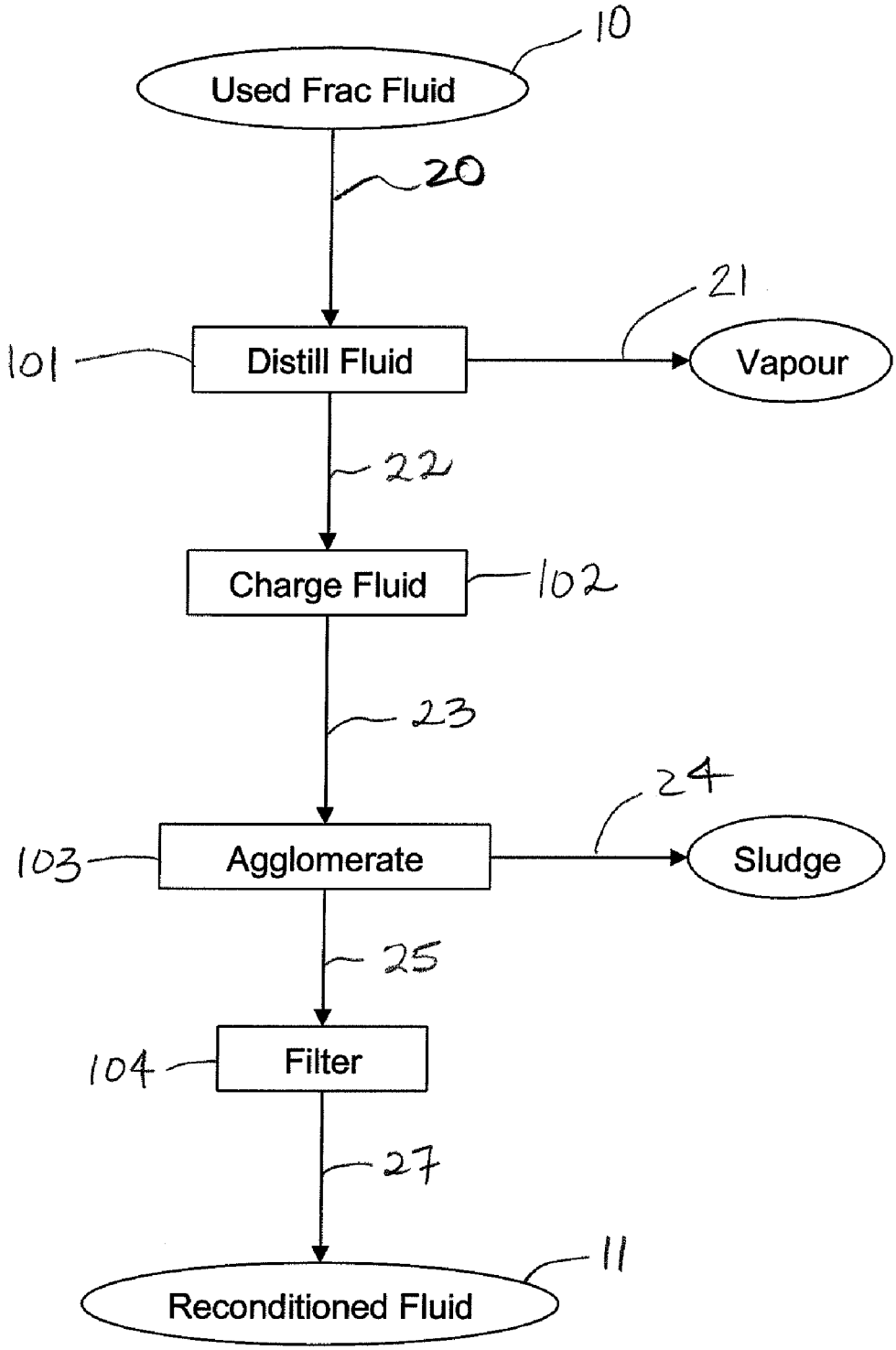
FIG. 1 is a flow chart of a treatment process according to an embodiment of the invention.

With reference to FIG. 1 and in an embodiment of the present invention, a process is shown for the treatment of used fracturing fluid 10 containing contaminants, such as contaminants produced from a wellbore, and forming a reconditioned fluid stream 11. The used fracturing fluid 10 is received for processing, forming an influent 20 which is first distilled at 101 for removal of vapor 21 and forming a liquid distilled fluid stream 22. The distilled fluid stream 22 is subjected to an electrostatic charge at 102 for forming a charged fluid stream 23 containing contaminants which have received positive and negative charges. The charged fluid stream 23 is temporarily stored for agglomeration at 103 so as to permit at least some of the charged contaminants to agglomerate, a portion of the agglomerates settling for recovery as a sludge 24. A decanted charged fluid stream 25 is filtered at 104 for removal of residual contaminants, including residual, unsettled agglomerates. Periodically a solid residue stream or accumulated filtrand (not shown) is cleaned from the filter or the filter with accumulated filtrand is replaced with a new filter. The filtered fluid stream or filtrate 27 forms the reconditioned fluid stream 11.

Figure 2:
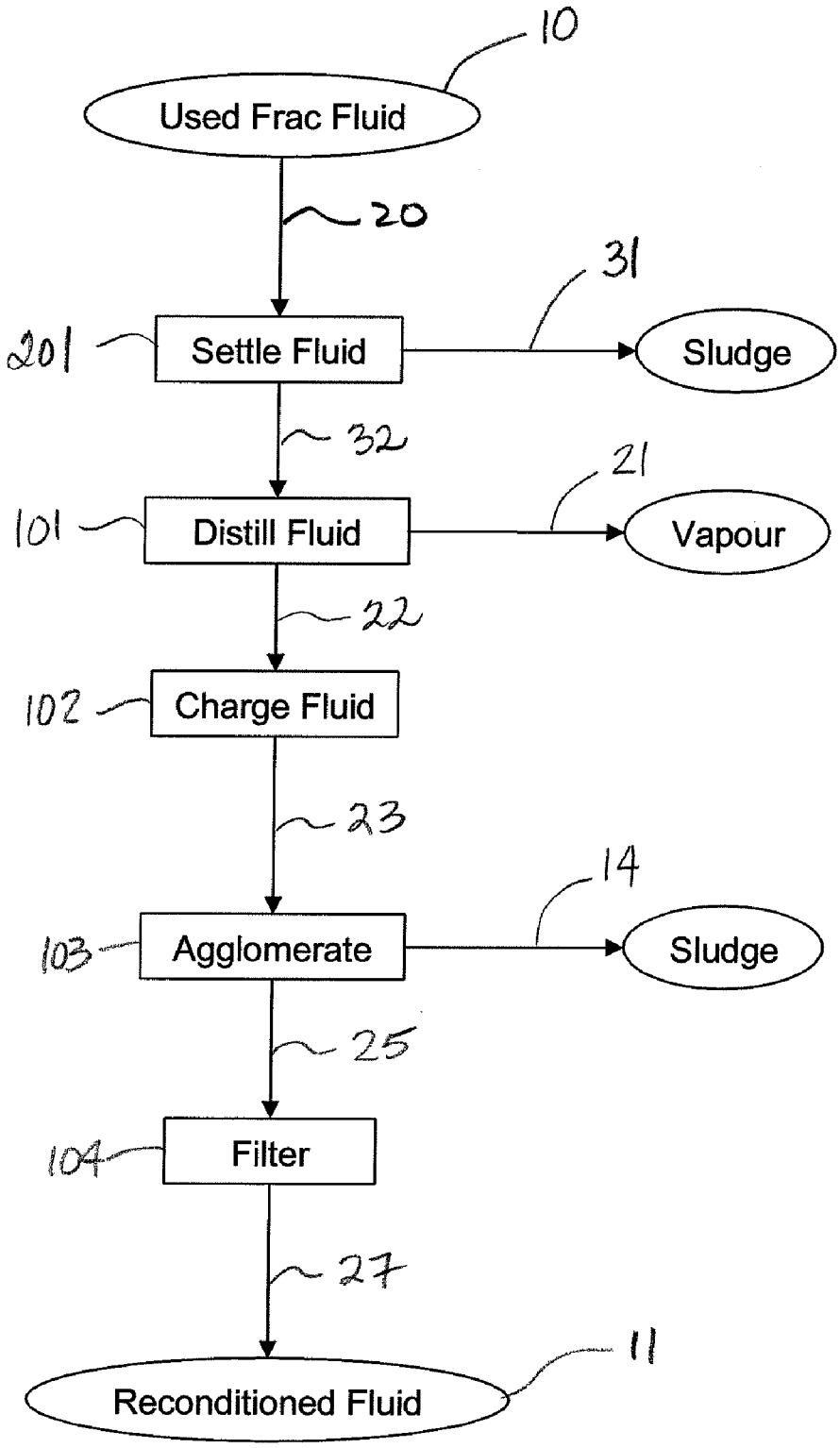
FIG. 2 is a flow chart of the treatment process of FIG. 1 further comprising settling before distilling.

As shown in FIG. 2, the influent 20 can first be stored at 201 so as to permit at least some of the contaminants in the influent 20 to settle for recovery as a sludge 31 and for forming a first decanted fluid stream 32. Large and heavy impurities, including particulates such as sand and the like, are permitted to settle, at least a portion of the influent 20, is decanted as the first decanted fluid stream 32. Similar to that shown in FIG. 1, the first decanted fluid stream 32 is directed for distillation at 101, charging at 102, agglomeration at 103 and filtering at 104 for producing the reconditioned fluid stream 11

Figure 3:
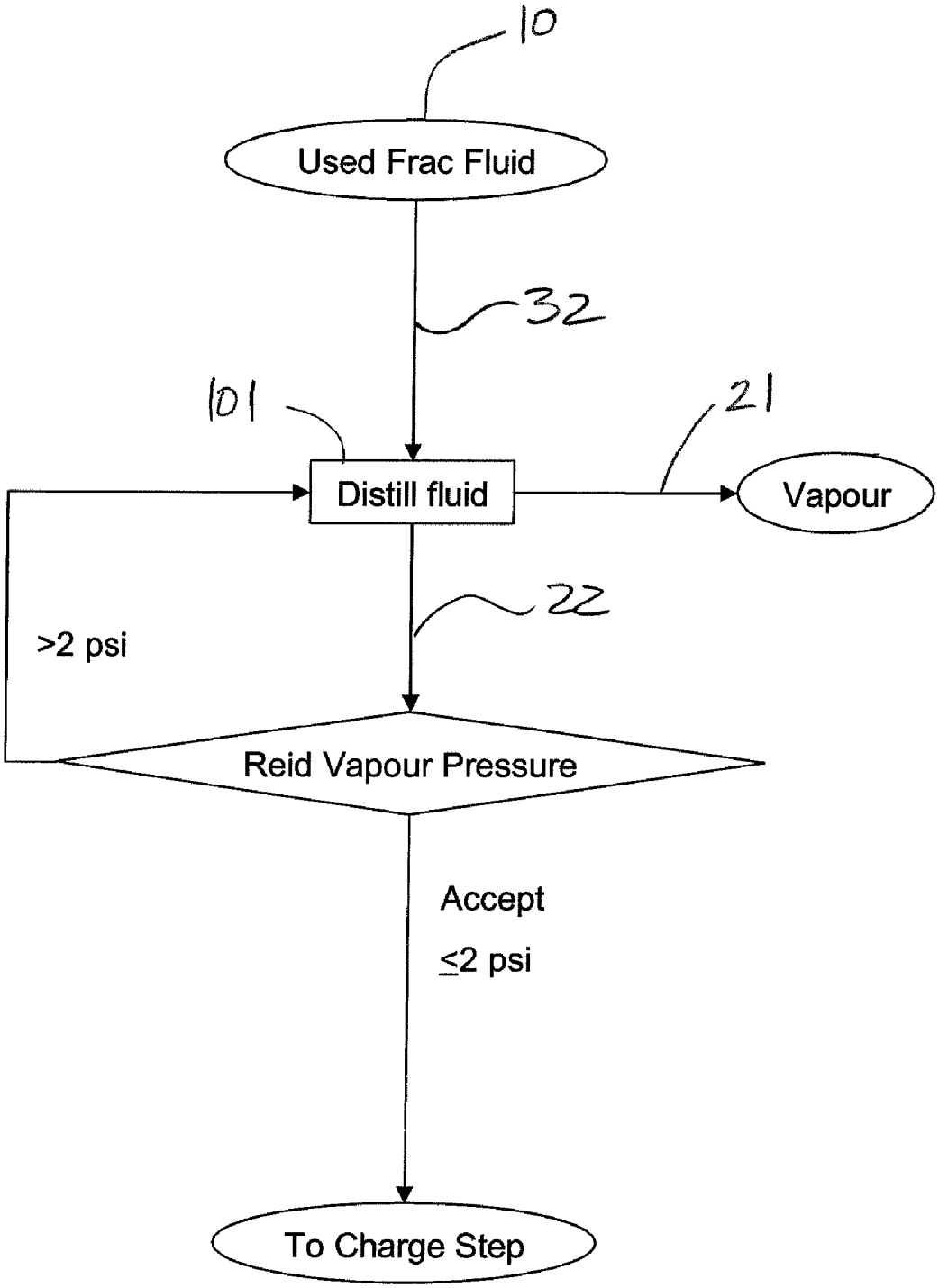
FIG. 3 is a flow chart of batch distilling to a threshold Reid Vapor pressure before further processing.

With reference to FIGS. 1 and 2 and further reference to FIG. 3, the first decanted fluid stream 32 is further clarified at the distillation step at 101. Distillation effects the removal of water and readily volatilized light hydrocarbons so that the distilled fluid stream 22 has vapor characteristics below a vapor pressure threshold, such as below a specified Reid Vapor Pressure (RVP) (ASTM Test #D-5191). The influent 20 or first decanted fluid stream 32 can be distilled continuously as long as the apparatus used for distilling at 101 is sized to achieve the vapor pressure threshold in a once-through pass. As shown in FIG. 3, in a batch configuration, the influent 20 or first decanted fluid stream 32 is subjected to the distillation step at 101 by recycling fluid 33 until the vapor pressure threshold is reached, at which point the distilled fluid stream 22 is directed for the charging at 102.

Figure 4:
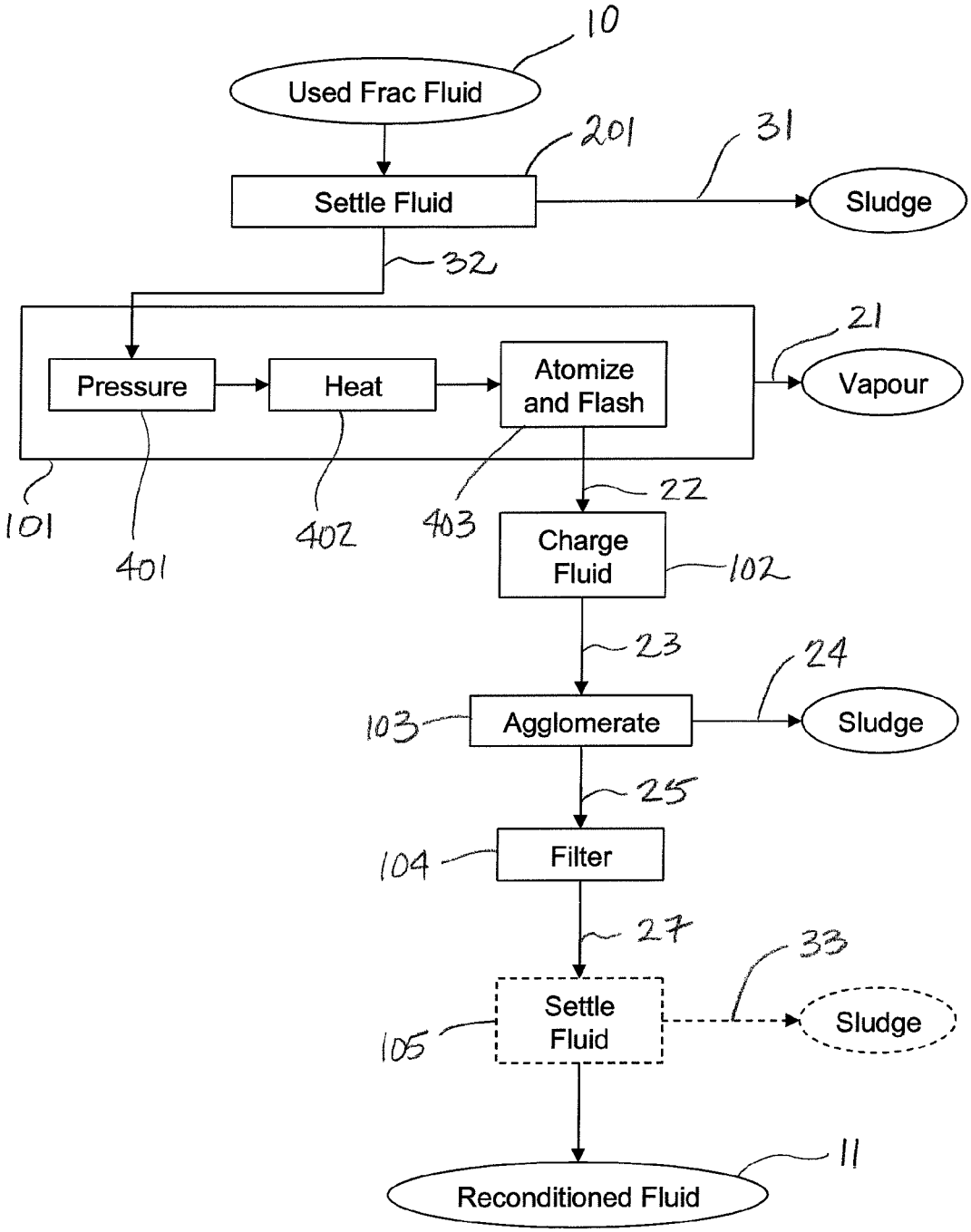
FIG. 4 is a flow chart of the treatment process of FIG. 2 illustrating an embodiment of the distilling step and an optional settling of the fluid following filtering.

With reference to FIG. 4, in embodiments of the invention, the removal of water and the light hydrocarbon ends can be accomplished by one or more of pressure variation 401, heating 402 and atomization and flashing 403 to effect distillation. Elevating the temperature of a fluid to a determined temperature permits distillation of at least some constituents within the fluid, such as the more volatile constituents and water and for forming the distilled fluid stream 22 which is substantially non-volatile. The influent 20 or first decanted fluid stream 32 is subjected to lower temperatures than are typically used in many conventional fractionation practices to remove volatile hydrocarbons so as to conserve energy consumption. The distillation of the influent 20 or first decanted fluid stream 32, to remove the light hydrocarbons and water, can be accomplished at sub-atmospheric, atmospheric and above-atmospheric pressures, the temperature at which the vaporization occurs being adjusted accordingly and as understood by those skilled in the art.

One such embodiment for distillation at 101 is to atomize and flash volatile constituents and water in a vapor zone Z at a determined pressure and temperature. The influent 20 or first decanted fluid stream 32 is introduced to the zone Z so as to form droplets which fall through the zone Z for recovery as the liquid distilled fluid stream 22. At the atomization and flash step at 403, the influent 20 or first decanted fluid stream 32 is discharged through a nozzle for atomizing the fluid stream. A pressure of the influent 20 or first decanted fluid stream 32 to the nozzle can be sufficient to prevent vapor evolution before reaching the zone Z.

As shown in FIGS. 1, 2, and 4, the charging at 102 and agglomeration at 103 can comprise exposing the distilled fluid stream 22 to electrostatic treatment for positive and negative charging of at least a portion of the contaminants therein for forming a charged fluid stream 23 containing positively charged and negatively charged contaminants therein. The charged fluid stream 23 is directed to storage to permit agglomeration of the charged contaminants at 103. Charged contaminants in the charged fluid stream 23 are permitted to form larger agglomerates through attraction of the oppositely-charged particles. The charged fluid stream 23 is stored at 102 to facilitate agglomeration. Depending upon the contaminants, storage could permit settling of at least a portion of the larger agglomerates which settle through gravity to form sludge 24. Agglomeration is permitted for a retention time of duration sufficient to agglomerate a substantial portion of the contaminants. An upper, substantially clarified portion is decanted for forming a decanted charged fluid stream 25.

As shown above, the decanted charged fluid stream 25 is subsequently filtered at 104 for forming the filtered fluid stream 27 so as to remove a substantial portion of residual contaminants and residual agglomerates therefrom for forming the product reconditioned fluid stream 11.

Optionally, as shown in dotted lines on FIG. 4, the reconditioned fluid stream 11 can be stored at 105 such as before shipment and reuse. Residual contaminants, if any, may further settle and form a final sludge 33.

Figure 5:
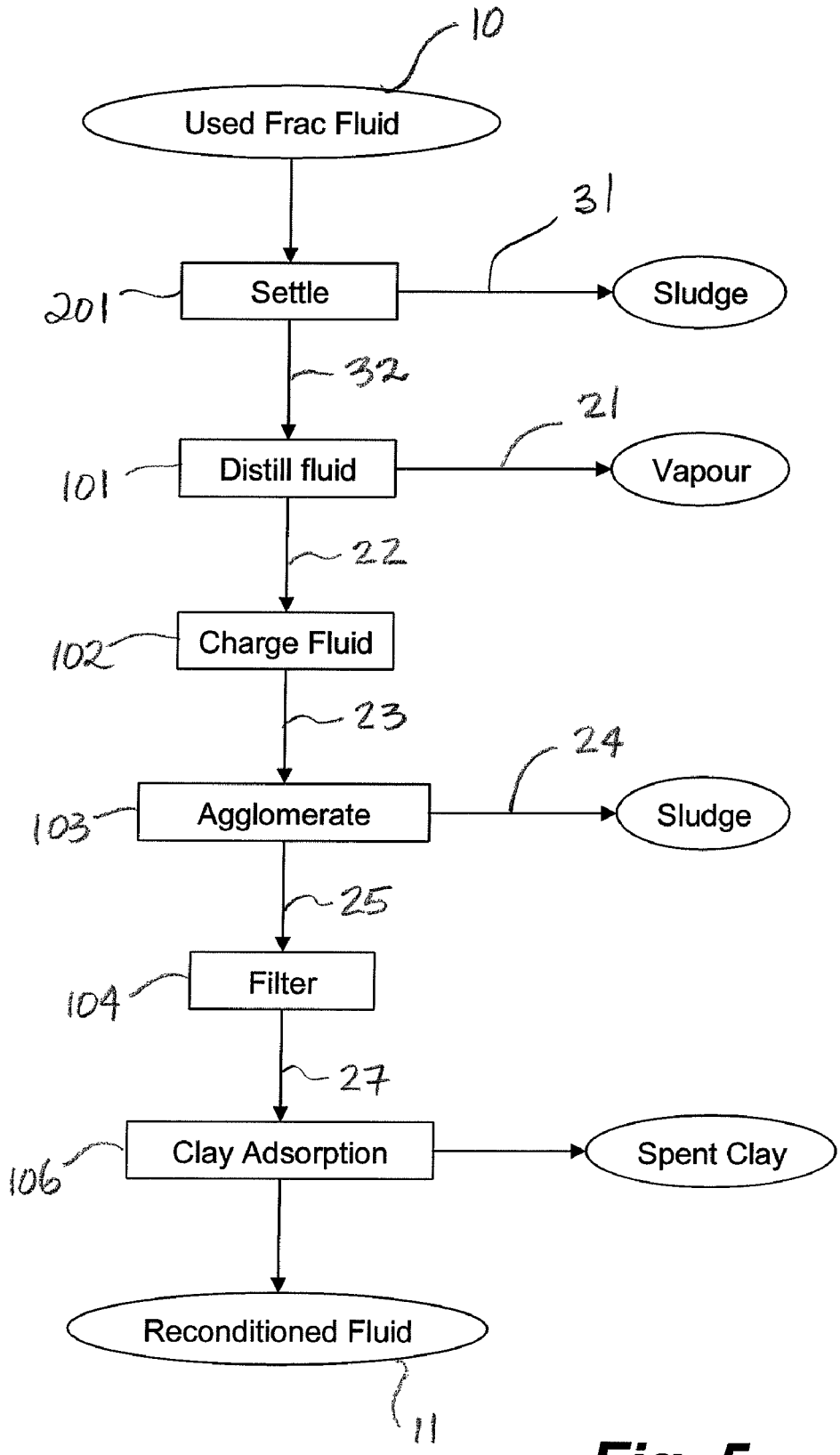
FIG. 5 is a flow chart of the treatment process of FIG. 2 further comprising, after filtering, treating the filtered fluid by clay adsorption.

With reference to FIG. 5, in an embodiment of the invention, clay-bed adsorption treatment can be optionally employed at 106 for receiving the filtered fluid stream 27. Passage of the filtered fluid stream 27 through the clay-bed adsorption treatment at 106 removes additional residual contaminants from the filtered fluid stream 27, such as some organometals and phosphates, particularly volatile phosphorus, which were not removed in earlier clarification steps. The effluent from the clay-bed adsorption treatment forms the reconditioned fluid stream 11.

According to embodiments of the invention, the influent 20 forms a liquid fluid stream F which is processed according to the various process steps described herein and for which different designations, such as decanted fluid stream, distilled fluid stream and the like have been applied. Several of the process steps are discussed in greater detail below, the fluid stream being described generically as fluid stream F for simplicity.

Distillation for Removal of Water and Light Hydrocarbons

In greater detail and with reference to an embodiment set forth in FIG. 8 for Example 1 below, the fluid stream F, being at the outset used fracturing fluid 10, is pumped to a distillation circuit for removal of water and light hydrocarbons. The distillation circuit may comprise a conventional degasser or two-phase separator known in the oil and gas industry or a thermal atomization circuit 101 of a type introduced in FIG. 4. The fluid stream F is subjected to the vapor zone Z therein at sub-atmospheric, atmospheric or above-atmospheric conditions with an appropriate temperature being applied thereto for vaporizing the light hydrocarbons and water. Higher pressures require higher temperatures to achieve volatilization.

In this embodiment of the invention, the zone Z in the thermal atomization circuit 101 is a vessel 60. A pool, sump or fluid level L of the fluid stream F is maintained in the vessel 60. The fluid stream F is discharged by pump P under pressure through a nozzle 62 into the vessel 60 above the fluid level L so as to volatilize water and light hydrocarbons therefrom. Light hydrocarbons are typically $C_1$-$C_6$ which, along with contained water, can be volatilized at temperatures of about 70-80° C. and pressures of about 5 psia to about 8 psia.

The fluid stream F is heated during pumping for minimizing the energy required to volatilize the volatiles contained therein, based upon an optimal pressure and temperature relationship. One or more suitable feed heaters or heat exchangers H, utilizing glycols such as propylene glycol as the heat transfer medium and which can be circulated at less than the boiling point to minimize vapor losses of the heat transfer fluids, are used to heat the fluid stream F. The fluid stream F is pumped through the heaters H and nozzle 62 at a sufficient pressure, typically about 40 psi, to minimize or prevent evolution of vapor in the heaters.

The nozzle 62 is located high in the vessel 60 above the fluid level L. A vapor stream 21, containing water and volatilized light hydrocarbons, is recovered from a top of the vessel 60. The fluid stream F is discharged to the sub-atmospheric vessel 60 as droplets 63 which are sized sufficient to fall through the sub-atmospheric vessel 60 to the fluid level L below for aiding in the removal of the light hydrocarbons and water and avoiding elutriation of liquid in the droplets 63 in the vapor stream 21 produced therefrom. It is believed that the formation of droplets 63 acts to effectively increase the surface area of the fluid stream F as it enters the vessel 60, thereby increasing the effectiveness of the temperature and pressure which act to vaporize or liberate the water and volatiles, substantially $C_1$-$C_6$, contained therein.

Volatilizing the light hydrocarbons at temperatures lower than may be typically used in many conventional practices to remove volatile hydrocarbons, acts to avoid the formation of acids, organic halides, volatile phosphorous and the like.

The vapor stream 21, comprising liberated light hydrocarbons and water, is removed from the vessel 60 by a vapor recovery pump 66 and directed to a condensate tank 68 wherein the vapor stream 21 is condensed to a condensate oil 70. The condensate oil 70 may be waste or saleable. The vapor recovery pump 66 can be a multi-phase pump. A portion of the condensed oil 70 can be recirculated as a slip stream 71 to the vapor stream 21 drawn into the multi-phase pump 66 to aid in extraction efficiency.

In an alternate embodiment of the invention which utilizes an atmospheric vessel 60, the fluid stream is heated to about 120° C.

Figure 6B:
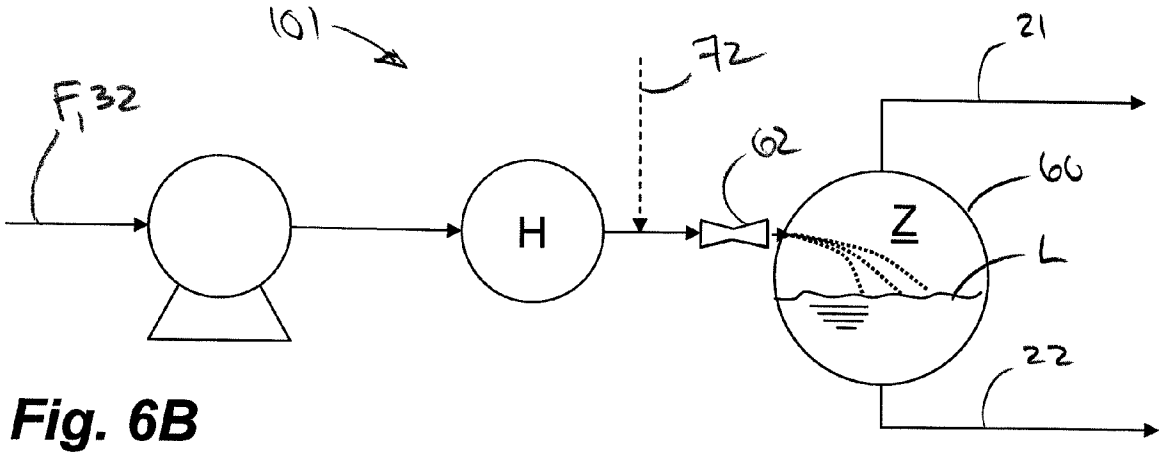
FIG. 6B is a process flow diagram of a once-through, continuous distillation or thermal atomization for forming a distilled fluid stream according to an embodiment of the invention.
Figure 6A:
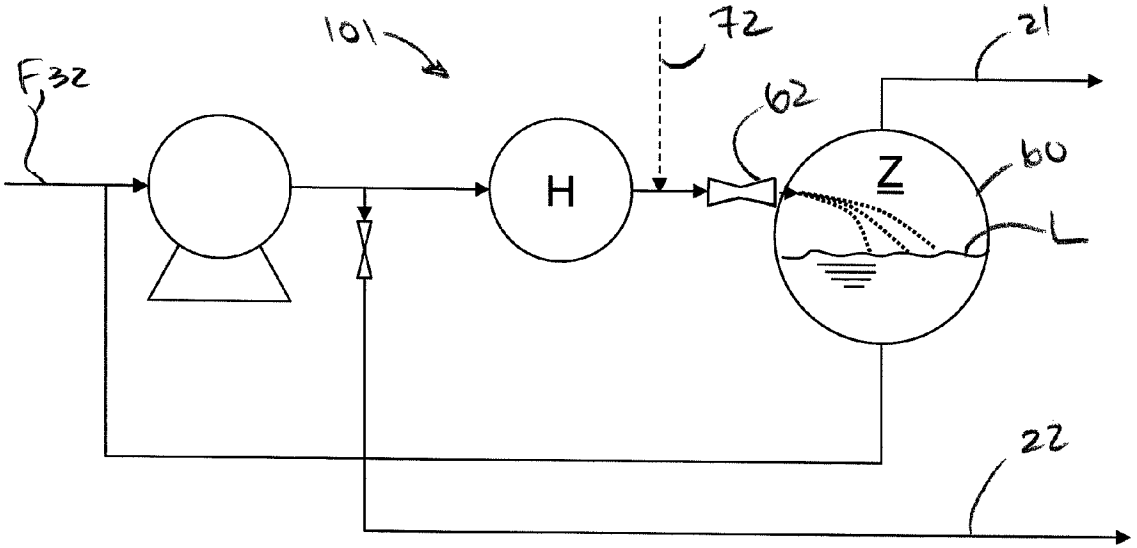
FIG. 6A is a process flow diagram of a batch distillation or thermal atomization circuit for forming a distilled fluid stream according to an embodiment of the invention.

Having reference to FIG. 6A, the distilled fluid stream 22, created from the thermal atomization circuit 101 may be repeatedly recycled through the thermal atomization circuit 101 for further removal of residual light hydrocarbons and water. Typically, the thermal atomization process is repeated until the Reid Vapor Pressure (RVP) has reached a lower vapor pressure threshold, forming the distilled fluid stream 22 which is substantially non-volatile. The particular RVP threshold selected is determined by the desired characteristics of the reconditioned fluid stream 11. For transport to and storage at oil and gas well locations and to minimize the risk of ignition and/or explosion, the RVP is substantially 2 psi or less.

Optionally, if it is determined that the used fracturing fluid 10 is gelled, as a result of chemical gelling agents in the fracturing fluid, chemicals such as a conventional breaker may be added to the fluid stream F in the thermal atomization circuit 101, such as before the nozzle 62, to break the gel prior to thermal atomization. In an embodiment of the invention, a dilute sodium hydroxide solution 72 is added to the fluid stream F to break any residual gel therein. Sufficient dilute sodium hydroxide 72 is added to break the gel. For example, in an embodiment of the invention, approximately 5 L dilute sodium hydroxide per 1000 L of the fluid stream F is added to the heated fluid stream F before the nozzle 62 as the fluid stream F is being pumped to the vessel 60. Maintaining the fluid stream F during pumping at the pressure of about 40 psi further permits shear mixing of the added breaker with the fluid stream F.

Alternatively, as shown in FIG. 6B, the fluid stream F may be continuously processed through the thermal atomization circuit 101 or can be processed only once should the RVP be acceptable.

Removal of Residual Contaminants

Electrostatic Agglomeration

Figure 7B:
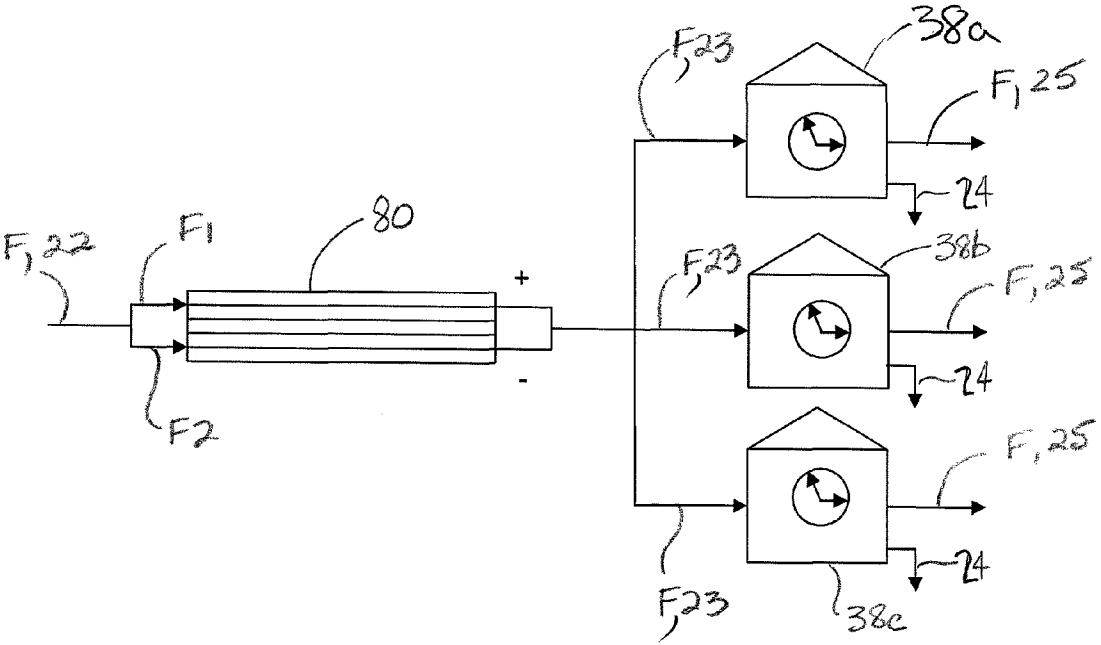
FIG. 7B is a process flow diagram of a continuous charging and batch retention of the distilled fluid stream according to an embodiment of the invention.
Figure 7A:
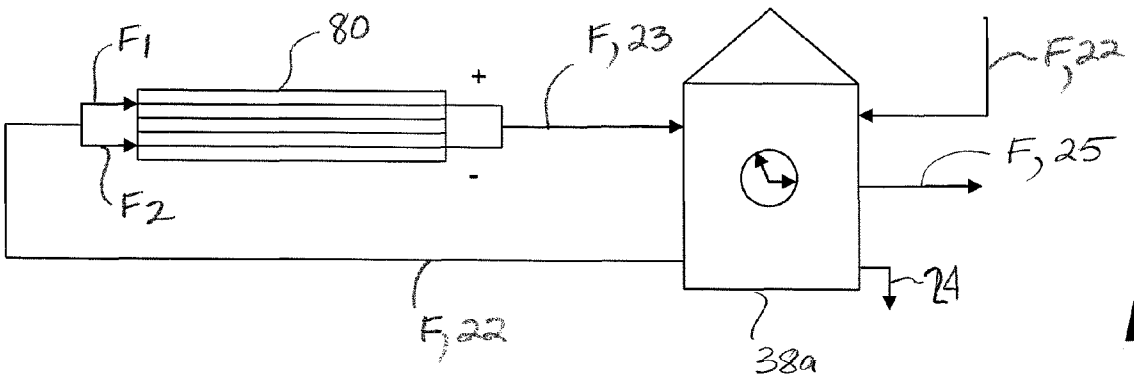
FIG. 7A is a process flow diagram of batch charging and agglomeration of the distilled fluid stream according to an embodiment of the invention.

With reference to FIGS. 7A and 7B, the fluid stream F from the distillation or thermal atomization circuit 101 is directed to an electrostatic precipitator or agglomerator 80. Entrained contaminants in the fluid stream F are positively and negatively charged therein. The oppositely charged particles entrained in the fluid stream F are permitted to contact and agglomerate, such as in retention tanks 38*a*,38*b* . . . over time, for forming agglomerates therebetween.

The fluid stream F from the retention tank 38*a*,38*b* . . . is split into two fluid streams F1, F2. A positive charge is imparted to at least a portion of the contaminants entrained in the first stream F1 and a negative charge is imparted to at least a portion of the contaminants entrained in the second stream F2. The first and second streams F1, F2 are re-combined for re-forming the fluid stream F which is directed again to the retention tank 38*a*,38*b* . . . for permitting contact between the positively and negatively charged particles contained therein for forming the agglomerates.

In one embodiment of the invention, the fluid stream F is drawn from about the bottom of the retention tank 38*a*, 38*b* . . . , treated through the electrostatic precipitator 80 and returned to the retention tank 38*a*,38*b* . . . . The fluid stream F is circulated until the entirety of the fluid stream F has been treated in the electrostatic precipitator 80, substantially the entirety of the batch of charged fluid stream 23 in the retention tank 38*a*, 38*b* . . . being substantially quiescent thereafter for facilitating settling of agglomerates.

In an alternate embodiment, a relatively small portion of the entirety of the batch of the recombined fluid F in the retention tank can be re-circulated from the retention tank 38*a*,38*b* . . . through the electrostatic precipitator 80 and back to the retention tank 38*a*,38*b* . . . to fall through the fluid stream F in the retention tank 38*a*,38*b* . . . to provide additional charging and further encourage and enhance agglomeration between the charged particles therein. During the charging re-circulation of fluid stream in the retention tank 38*a*,38*b* . . . , the batch is substantially quiescent.

Agglomeration is permitted to occur over time. In some instances, larger agglomerates settle by gravity over time forming the top, substantially clarified fluid portion and the bottom agglomerate or sludge portion 24. The substantially clarified fluid portion 25 is decanted and the fluid stream F is filtered.

Filtering

As shown in FIG. 1, the fluid stream F is subsequently pumped from the retention tank 38*a*,38*b* . . . for passage through one or more filters 84. The filter medium is sized for removal of residual contaminates which did not agglomerate and/or agglomerates which did not settle in the retention tank 38*a*,38*b* . . . .

In an embodiment of the invention, a filter 84 of about 2 micron is used which is capable of removing a large number of residual contaminants from the fluid stream F. The fluid stream F is pumped through the filter 84 at a rate sufficiently low to maximize filter efficiency.

The fluid stream F, following filtering, is suitable for use as a recycled or reconditioned hydrocarbon base oil and is typically stored in product storage tanks 86*a*,86*b* . . . for reuse.

Applicant has found that residual effects from the electrostatic precipitation can continue to occur following filtering and in product storage tanks 86*a*,86*b* . . . . Over time, residual positively and negatively charged contaminates may continue to agglomerate and settle in the product storage tanks 86*a*, 86*b* . . . . Typically, product removed from the product storage tanks 86*a*,86*b* . . . is removed from an outlet spaced from a bottom of the product storage tank 86*a*,86*b* . . . to avoid entraining agglomerates which may have settled to the bottom of the tank 86*a*,86*b* . . . .

Clay Adsorption

In an embodiment of the invention, the fluid stream F, following filtering, is further passed through one or more clay-bed treatment towers 90 to remove residual contaminants, including but not limited to organometals, phosphorus, volatile phosphorus or metal- or phosphorus-containing contaminants for forming the fluid stream F which is stored for reuse. Typically, following clay treatment, the fluid stream F is sufficiently clarified so as to be used for producing new fracturing fluids. The clay-bed treatments towers 90 are typically packed with attapulgite clay.

Applicant has found that treatment of used fracturing fluid 10 by embodiments of the invention prolongs the longevity of the action of the clay and further acts to facilitate successful reactivation of the clay, such as by periodic thermal reactivation techniques.

Continuous Treatment

Figure 9:
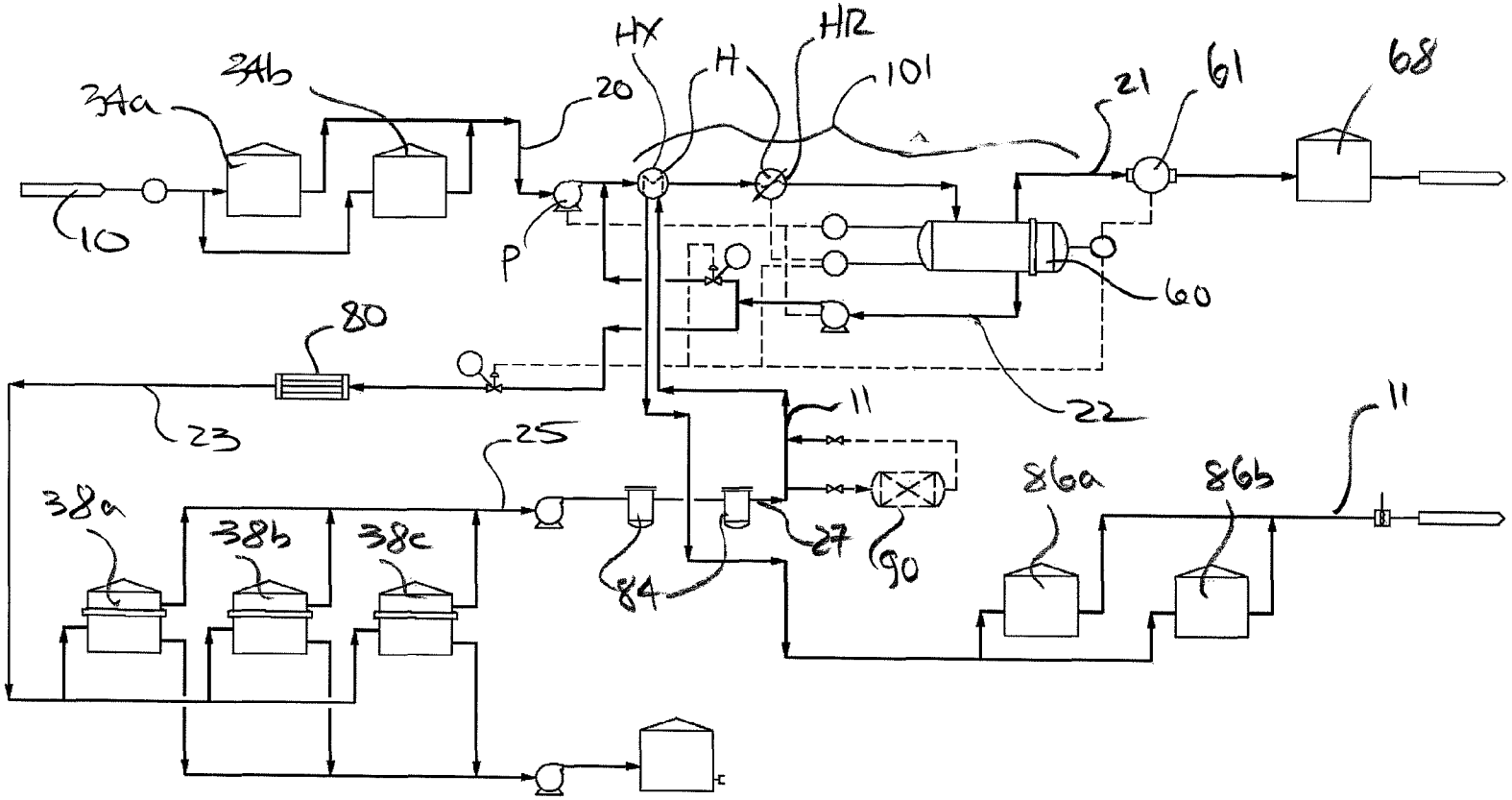
FIG. 9 is a process flow diagram of a continuous flow process according to an embodiment of the invention.

Having reference to FIGS. 6B, 7B and 9, a substantially continuous flow process according to another embodiment of the invention, is shown.

As in the batch process, used fracturing fluid 10 is received at receipt or storage tanks 34*a*,34*b* . . . and pumped therefrom as influent 20 or a first decanted fluid 32 if permitted to settle, for treatment by thermal atomization 101. Pumps P, heating apparatus H and the sub-atmospheric vessel 60 are sized sufficient to handle continuous flow. Heating of the fluid stream F is accomplished using heat exchangers HX for heat scavenging from the distilled fluid stream 22 or from the final reconditioned fluid stream 11. An additional feed heater HR provides the heat required to achieve the process temperature. In a semi-continuous process, the distilled fluid stream 22 is pumped directly from the thermal atomization vessel 60 and continuously through the agglomerator 80 and is stored in sequential batch retention tanks 38*a*,38*b* . . . for formation and settling of agglomerates therein. As many agglomeration retention tanks 38*a*,38*b* . . . are provided as necessary to permit the design retention time in each while the charged fluid stream 23 flows into sequential retention tanks 38*a*, 38*b* . . . . Decanted charged fluid stream 25 flows to filter 84. The filtering can be conducted using multiple filters 84 for enabling cleaning or regeneration of off-line filters 84 while filtering the fluid stream in an on-line filter 84.

Example 1

Figure 8:
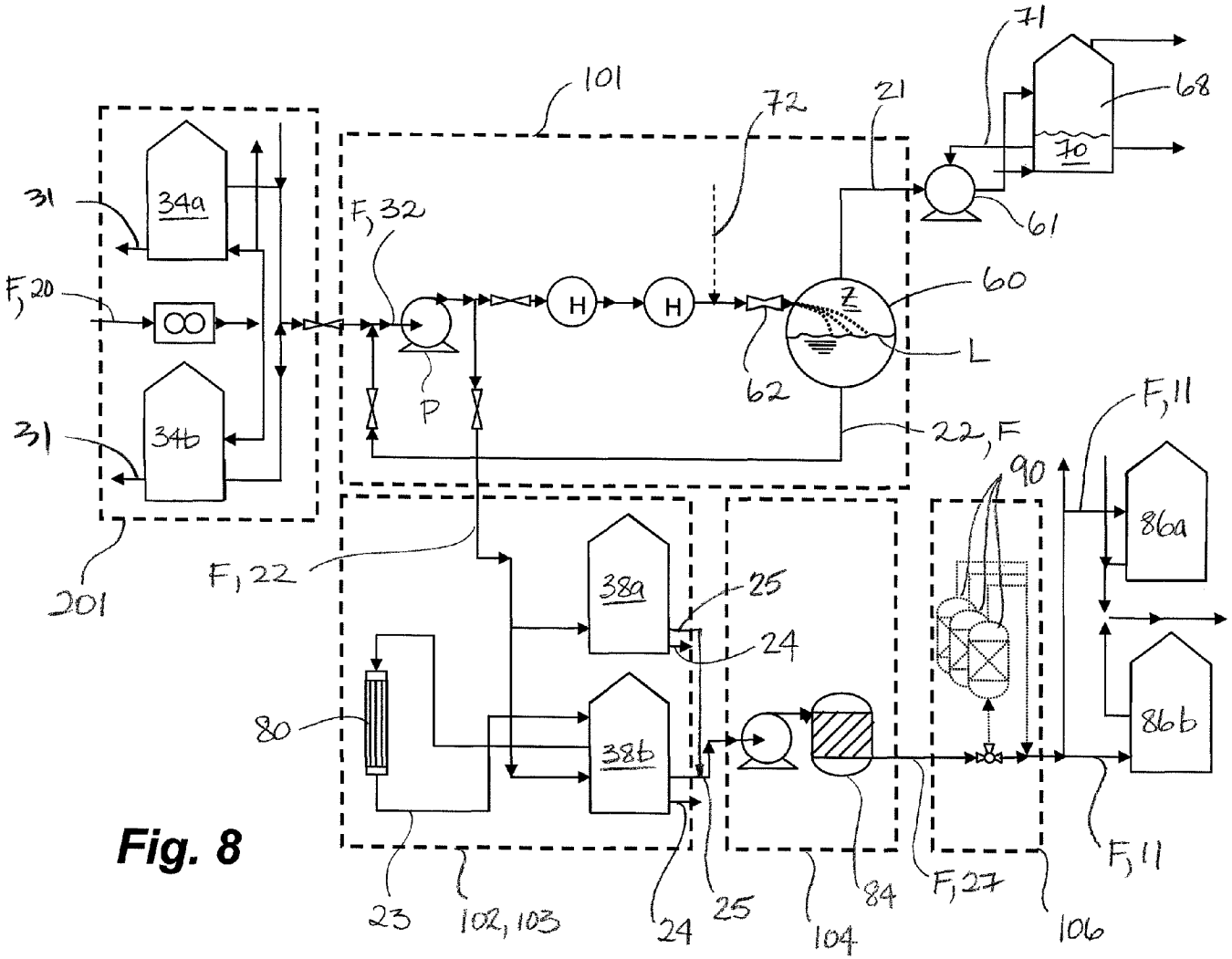
FIG. 8 is a process flow diagram of a batch treatment process according to an embodiment of the invention.

As shown in FIGS. 8 and 9, the treatment of used fracturing fluid 10 can be performed by batch processing (FIG. 8), continuous processing (FIG. 9) or combinations thereof. Those of skill in the art would appreciate apparatus for performing the methodology of embodiments of the invention can be sized appropriately for enabling continuous flow or batch processing.

With reference again to FIG. 8, a treatment facility 1 is shown which was operated for processing batches of used fracturing fluid 10.

Loads of about 50 $m^3$ per load of used fracturing fluid 10 from a wellbore were received by tanker truck and stored in 60 $m^3$ receipt tanks 34*a*,34*b* . . . . Some of the larger and heavier contaminants and particulates had gravity settled and a top portion was recovered as first decanted fluid 32 and a sludge 31 was collected on the bottom of the tanks 34*a*, 34*b* . . . . The receipt tanks 34*a*,34*b* . . . were conventional sloped bottom tanks having an inlet for receiving the used fracturing fluid 10, a first bottom outlet for periodic removal of the settled sludge 31, and a second outlet 9 located above the first outlet for removal of the first decanted fluid stream 32 for subsequent treatment by the distillation or thermal atomization circuit 101. Batches of about 7 to 8 $m^3$ of the first decanted fluid stream 32 were pumped from the receipt tanks 34*a*,34*b* . . . to the thermal atomization circuit 101. A 4 inch T&E gear pump P available from T&E Pumps Ltd. Consort, Alberta, Canada was used which was capable of pumping at rates of between about 0.2 $m^3$/min and about 1.2 $m^3$/min.

In the thermal atomization circuit 101, the first decanted fluid stream 32 was pumped through a 112 kW heat exchanger HX and a 112 kW feed heater HR for raising the temperature of the first decanted fluid stream 32 to about 75° C. At that temperature, the first decanted fluid stream 32 was pumped at about a pressure of 40 psi to prevent vapor evolution therein. The first decanted fluid stream 32 was discharged through nozzle 62 as droplets 63 into a zone Z of sub-atmospheric pressure in the vessel 60. The nozzle 62 had an inner diameter of about ½ inch for forming droplets which fell through the zone Z for recovery as a fluid while volatiles were liberated therefrom. A suitable vessel 60 was rated to pressures of about 150 psi and was maintained at a sub-atmospheric pressure of about 5 to about 8 psi. The vessel 60 was insulated for heat conservation.

A vapor stream 21 containing the volatilized light hydrocarbons and water was removed from the vessel 60 using a vapor pump 61, such as a 4.9 kW, 10.3 $m^3$/hr 4" T&E gear pump, available from T&E Pumps Ltd. Consort, Alberta, Canada, capable of flow rates of between about 0.2 $m^3$/min and about 1.2 $m^3$/min. The vapor stream 21 was condensed in the 60 $m^3$ condensate tank 68. A portion of the condensed liquids were recycled to the vapor pump 61 for combining with the vapor stream 21 for increasing the effectiveness of the vapor pump 61 in achieving vacuum conditions in the sub-atmospheric vessel 60. The non-volatilized droplets in the vessel 60 were collected.

The distilled fluid stream 22 was sampled and RVP was determined. As long as the RVP was greater than about 2 psi, the distilled fluid stream 22 was recirculated through the thermal atomization circuit 101 until such time as the RVP was substantially 2 psi or less. Depending upon the contents of the used fracturing fluid 10, the thermal atomization circuit 101 took between about 1 hours and 4 hours to process a 7-8

$m^3$ batch. When the RVP of the distilled fluid stream 22 reached substantially 2 psi or less, the distilled fluid stream 22 was pumped into one or more 60 $m^3$ retention tanks 38*a*, 38*b* . . . of the agglomeration step. Each tank 38*a*,38*b* . . . could be used for sequential batches.

The retention tank 38*a*,38*b* . . . , received the distilled fluid stream 22 from the thermal atomization circuit 101. The distilled fluid stream 22 was circulated from a bottom of the retention tank 38*a*,38*b* . . . , and through an electrostatic precipitator (ESP) or agglomerator 80, such as that available from ISOPur Fluid Technologies Inc., Pawcatuck, Conn., USA. In this case, as shown in FIG. 7A, the distilled fluid stream 22 was separated into two parallel streams, a first stream F1 which is positively charged through the ESP and a second stream F2 which is negatively charged by the ESP 80. The first and second electrostatically charged streams F1, F2 were re-combined as a charged fluid stream 23 and circulated back into the retention tank 38*a*,38*b* . . . . Once the entire batch was charged, the charged fluid stream 23 was allowed to stand, in this instance as a quiescent liquid batch, for about 12 hours for forming agglomerates therein. Some agglomerates, which were capable of gravity settling, settled to the bottom of the retention tank 38*a*,38*b* . . . , forming a bottom agglomerated portion and an upper substantially clarified portion. Settled agglomerates 24 were recovered periodically from the bottom of the retention tank 38*a*,38*b* . . . . The charged fluid stream 23 and residual unsettled agglomerates were decanted from an upper outlet in the retention tank 38*a*,38*b* . . . . This second decanted fluid stream 25 was pumped to the filtering step 104.

The decanted charged fluid stream 25 was filtered through a 2 μm polyurethane bag filter 84 available from 3M®, St. Paul Minn., USA for forming a filtered fluid stream 27. The filter 84 was oversized for the flow rate of the batch being filtered. While capable of higher flow rates, the second decanted fluid stream 25 was pumped through the filter 84 at a rate sufficiently low to maximize filter efficiency. The second decanted fluid stream 25 was pumped through the filter 84 with a pressure differential of 15 psi or less.

As an option, following filtering, the filtered fluid stream 27 was pumped through one or more clay polishing towers 90, such as reactivatable polish towers containing attapulgite clay, available from FilterVac, Breslau, Ontario, Canada. The clay treatment towers 90 can removing residual contaminants such as volatile phosphorus, residual organometals and heavy hydrocarbons such as $C_{20}$ or greater for producing a final product or reconditioned fluid stream 11.

Example 2

For demonstrating the capabilities of the exemplary embodiment of Example 1, the effectiveness of the process for removal of metals is set forth below.

Table 1 shows the total metal content of two samples of fluid: a sample of used fracturing fluid prior to treatment and a final reconditioned fluid stream produced by the embodiment of Example 1. The first sample was from the first decanted fluid stream.

As shown in Table 1 below, substantially all of the free metals found in the used fracturing fluid prior to treatment were removed from the final product stream. Most notable is phosphorous wherein 514 mg/kg of fracturing fluid was removed. Also notable was the substantial removal of iron, lead, calcium, aluminum and silicon from the first decanted fluid stream or lack thereof in the final product stream.

TABLE 1

| Metal | mg metal/kg frac fluid | mg metal/kg production fluid produced |
|---|---|---|
| Aluminum | 15 | 0 |
| Barium | 3 | 0 |
| Boron | 3 | 0 |
| Calcium | 12 | 0 |
| Chromium | 0 | 0 |
| Copper | 2 | 0 |
| Iron | 803 | 39 |
| Lead | 6 | 1 |
| Magneisum | 11 | 0 |
| Manganese | 1 | 0 |
| Molybdenum | 0 | 0.05 |
| Nickel | 0 | 0.05 |
| Phosphorous | 534 | 20 |
| Silicon | 31 | 2 |
| Silver | 0 | 0.01 |
| Sodium | 2 | 8 |
| Tin | 0 | 0 |
| Vandium | 0 | 0 |
| Zinc | 6 | 0 |

The Applicant also noted that the overall amount of sodium actually increased from 2 mg/kg to 8 mg/kg. Applicant believes that this is accurate and does not attribute the increase of sodium to laboratory anomalies, but rather due to the addition of sodium hydroxide in the initial steps of the process to serve as a chemical breaker to counter the gelling effects of the gelling additives added to the used fracturing fluid.

Example 3

Table 2 is a summary of the constituents of the first decanted fluid stream from the receipt tanks prior to treatment in the thermal atomization circuit. More particularly, Table 2 summarizes the hydrocarbon content of the first decanted fluid stream and the hydrocarbon content of the non-volatile fluid stream formed after the removal of water and light hydrocarbons.

The first decanted fluid stream was heated to about 75° C. The nozzle maintained a backpressure of about 40 psi, the sub-atmospheric vessel was at sub-atmospheric pressures between 5 psi and 8 psi. The batch of used fracturing fluid was circulated and samples were taken until the RVP was below 2 psi.

A sample of the first decanted fluid stream and a sample of the non-volatile fluid stream were subjected to gas chromatography to $C_{30}$ fractionation (GC30 fractionation) to determine the mole fractions of the various hydrocarbon constituents present in the two fluid streams as summarized in Table 2. The GC 30 Fractionation was conducted on the fluid stream at RVP of 8.8 psi (before thermal atomization circuit), 4.4 psi and 1.7 psi (after thermal atomization circuit) and the total percent reduction for each constituent was calculated for each sample.

TABLE 2

| Constituent | Number Carbons | Mole Fraction 8.8 psi RVP Density 762.2 kg/m3 | Mole Fraction 4.4 psi RVP Density 774.7 kg/m3 | Mole Fraction 1.7 psi RVP Density 776.7 kg/m3 |
|---|---|---|---|---|
| Methanes | 1 | 0 | 0 | 0 |
| Ethanes | 2 | 0.0012 | 0 | 0 |
| Propanes | 3 | 0.0168 | 0.0025 | 0.002 |
| Iso-Butanes | 4 | 0.0145 | 0.0051 | 0.0008 |
| Butanes | 4 | 0.0329 | 0.0147 | 0.0037 |
| Iso-Pentanes | 5 | 0.0168 | 0.0118 | 0.0057 |
| Pentanes | 5 | 0.0251 | 0.0172 | 0.0094 |
| Hexanes | 6 | 0.0367 | 0.0281 | 0.0197 |
| Heptanes | 7 | 0.0852 | 0.0894 | 0.0911 |
| Octanes | 8 | 0.1895 | 0.1828 | 0.193 |
| Nonanes | 9 | 0.1079 | 0.1172 | 0.1259 |
| Decanes | 10 | 0.0615 | 0.0882 | 0.0926 |
| Undecanes | 11 | 0.0452 | 0.0488 | 0.0563 |
| Dodocanes | 12 | 0.0285 | 0.0308 | 0.0338 |
| Tridecanes | 13 | 0.021 | 0.0299 | 0.0239 |
| Tetradecanes | 14 | 0.0141 | 0.015 | 0.0165 |
| Pentadecanes | 15 | 0.0094 | 0.0101 | 0.011 |
| Hexadecanes | 16 | 0.0061 | 0.0066 | 0.0075 |
| Heptadecanes | 17 | 0.0053 | 0.0059 | 0.0057 |
| Octadecanes | 18 | 0.0038 | 0.0038 | 0.004 |
| Nonadecanes | 19 | 0.0034 | 0.0038 | 0.003 |
| Elcosanes | 20 | 0.0023 | 0.0029 | 0.0023 |
| Henelcosanes | 21 | 0.0025 | 0.0023 | 0.002 |
| Docosanes | 22 | 0.0014 | 0.0016 | 0.0015 |
| Tricosanes | 23 | 0.0016 | 0.0019 | 0.0009 |
| Tetracosanes | 24 | 0.0013 | 0.0014 | 0.0007 |
| Pentacosanes | 25 | 0.0012 | 0.0011 | 0.0003 |
| Hexacosanes | 26 | 0.0006 | 0.0009 | 0.0001 |
| Heptacosanes | 27 | 0.0007 | 0.0008 | 0 |
| Octacosanes | 28 | 0.0008 | 0.0008 | 0 |
| Nonacosanes | 29 | 0.0003 | 0.0003 | 0 |
| Triacontanes Plus | 30 | 0.0002 | 0.0037 | 0 |
| Benzene | C6—H6 | 0.0044 | 0.0044 | 0.0044 |
| Toluene | C7—H8 | 0.0622 | 0.0663 | 0.0668 |
| Ethylbenzene | C8—H10 | 0.0071 | 0.0078 | 0.0086 |
| 0-xylene | C8—H10 | 0.0766 | 0.0852 | 0.0911 |
| Trimetehylbenzene | C8—H12 | 0.012 | 0.013 | 0.0143 |
| Cycolpentane | C5—H10 | 0.0008 | 0.0006 | 0.0003 |
| Methylcyclopentane | C6—H12 | 0.0063 | 0.0063 | 0.0061 |
| Cyclohexane | C6—H12 | 0.0159 | 0.0163 | 0.0154 |
| Methylcyclohexane | C7—H14 | 0.0739 | 0.0781 | 0.0794 |

Mole fractions at 8.8 psi RVP were indicative of the constituent hydrocarbon content of the first decanted fluid stream of Example 2. The mole fractions at 1.7 psi RVP were indicative of the constituent hydrocarbon content of the non-volatile fluid stream after a sufficient number of recirculations to reduce RVP to less than 2 psi. Methane and ethane were present in negligible amounts in the original sample and thus there were no appreciable reductions in the amount of methane and ethane. However, the amount of light hydrocarbon constituents, such as $C_3$-$C_6$ hydrocarbons present in the non-volatile fluid stream, were substantially reduced.

Example 4

The electrostatic precipitator or agglomerator discussed in Example 1 was tested using three different samples of used fracturing fluid.

The metal content of the sample prior to passing through the agglomerator was determined. The sample was passed through the agglomerator for electrostatically charging the contaminants present in the sample. The charged fluid was then allowed to agglomerate and settle in the retention tanks, quiescent for a period of 12 hours.

A top portion of the charged fluid was decanted to form a second decanted fluid stream which was passed through the 2 μm bag filter to form the filtered fluid stream. The second decanted fluid stream and the filtered fluid stream from the filter was tested for the presence of metals, and the results illustrated in Table 3 below.

TABLE 3

| Metal | mg metal/kg of fluid prior to electrostatic precipitation | mg metal/kg of fluid in second decanted fluid stream | mg metal/kg of fluid in filtered fluid stream |
|---|---|---|---|
| Aluminum | 4 | 2 | 2 |
| Chromium | 0 | 0 | 0 |
| Copper | 1 | 0 | 0 |
| Iron | 604 | 366 | 365 |
| Tin | 0 | 0 | 0 |
| Lead | 2 | 1 | 0 |
| Silicon | 102 | 65 | 65 |
| Molybdenum | 1 | 0 | 0 |
| Nickel | 0 | 0 | 0 |
| Silver | 0 | 0 | 0 |
| Potassium | 1 | 0 | 0 |
| Sodium | 6 | 3 | 3 |
| Boron | 2 | 1 | 1 |
| Barium | 1 | 0 | 0 |
| Calcium | 14 | 7 | 7 |
| Magnesium | 71 | 40 | 39 |
| Phosphorous | 274 | 176 | 174 |

It appears that the agglomeration of the electrostatically charged metals and settling thereof effectively removes approximately half of the metals present in the first decanted fluid stream. As Table 3 shows, approximately half of the aluminum, copper, silicon, calcium and magnesium were removed (settled out by gravity separation) during the agglomeration step and the remaining amounts of these metals were effectively removed during filtration.

Example 5

Table 4 shows the effectiveness of metal and phosphorous removal during the absolute filtration using a 2 micrometer bag filter and treatment with clay.

A control sample, directly from the tanker truck was tested for the presence of metals prior to being subjected to filtration and then treatment in the clay towers. A 0.5 $m^3$ sample directly from the truck was filtered through a 3M® polyurethane bag filter and then passed through 6 consecutive clay towers for a period of one hour at a flow rate of 5.4 gallons per minute. Samples from the filtered fluid stream and samples of the product fluid stream from the clay towers were tested for the presence of metals.

Substantial amounts of metals were removed during the filtration step. Most notable are phosphorous and iron, with approximately 363 mg of phosphorous/kg of fracturing fluid and 173 mg of iron/kg of fracturing fluid being filtered out. This was consistent with the results of Example 4, wherein substantial amounts of metals present in the original sample were removed during absolute filtration and not during agglomeration.

Further, any remaining metals were removed by the clay towers to produce a product stream that was substantially free of metals.

TABLE 4

| Metal | mg metal/kg of frac fluid | mg metal/kg frac fluid in fluid steam | mg metal/kg frac fluid after clay towers |
|---|---|---|---|
| Aluminum | 17 | 5 | 0 |
| Barium | 5 | 1 | 0 |
| Boron | 1 | 0 | 0 |
| Calcium | 8 | 22 | 1 |
| Copper | 1 | 1 | 0 |
| Iron | 244 | 71 | 3 |
| Lead | 2 | 2 | 0 |
| Magnesium | 23 | 36 | 2 |
| Phosphorous | 447 | 84 | 0 |
| Silicon | 44 | 3 | 0 |
| Sodium | 39 | 5 | 0 |
| Zinc | 2 | 1 | 0 |

Reactivation of Clay Towers

It is known that clay towers, such as the reactivable Clay Towers from FilterVac, regularly require regeneration, such as through thermal reactivation, as the attapulgite clay saturate with the filtered contaminants. Such saturation of the attapulgite clay reduces the overall effectiveness and ability of the clay towers to remove contaminants from a fluid stream such as the reconditioned fluid stream.

Further, contaminated fluids negatively impact the ability to reactivate the clay in clay towers. To applicant's knowledge, clay towers could not be successfully operated with a reactivation cycle if fluids with characteristics similar to used fracturing fluids were treated. The contaminants therein render the clay incapable of thermal reactivation. However, the fluid treatment process as set forth in the embodiment above now render the filtered fluid stream originating from, used fracturing oils, suitable for clay tower treatment with reactivation.

Table 5 shows the results of the ability to reactivate a clay tower's capacity for continued removal of residual contaminants from a fluid stream.

TABLE 5

| Metal | mg/kg fluid prior to clay treatment | mg/kg fluid 250 L processed | mg/kg fluid 500 L processed | mg/kg fluid 750 L processed | mg/kg fluid prior to reactivation | mg/kg fluid post activation in waste |
|---|---|---|---|---|---|---|
| Aluminum | 7 | 0 | 2 | 3 | 6 | 9 |
| Chromium | 0 | 0 | 0 | 0 | 0 | 0 |
| Copper | 1 | 1 | 0 | 0 | 0 | 0 |
| Iron | 616 | 16 | 128 | 244 | 334 | 157 |
| Tin | 0 | 0 | 0 | 0 | 0 | 0 |
| Lead | 2 | 2 | 0 | 1 | 1 | 1 |
| Silicon | 3 | 0 | 0 | 1 | 2 | 3 |
| Molybdenum | 0 | 0 | 0 | 0 | 0 | 0 |
| Nickel | 0 | 0 | 0 | 0 | 0 | 0 |
| Silver | 0 | 0 | 0 | 0 | 0 | 0 |
| Potassium | 2 | 0 | 0 | 1 | 0 | 0 |
| Sodium | 2 | 0 | 1 | 2 | 1 | 0 |
| Boron | 3 | 0 | 1 | 1 | 2 | 0 |
| Barium | 0 | 0 | 0 | 0 | 1 | 0 |
| Calcium | 8 | 0 | 2 | 4 | 6 | 5 |
| Magnesium | 16 | 0 | 3 | 8 | 9 | 3 |
| Manganese | 1 | 0 | 0 | 1 | 1 | 0 |
| Phosphorus | 430 | 9 | 30 | 80 | 104 | 34 |
| Zinc | 3 | 0 | 1 | 1 | 2 | 2 |
| Total | 1094 | 28 | 168 | 347 | 469 | 214 |

As seen, most notably with iron and phosphorous, the effectiveness of the clay towers to remove contaminants steadily decreased as the treatment volume of fluid passed through the clay towers increased, suggesting a gradual saturation of the clay's capacity to remove contaminants therefrom.

According to the data, in column 5, just prior to regeneration of the clay towers, only about half (334 mg) of the iron originally present (616 mg) in the fluid stream was being removed from the fluid stream. After regeneration, the clay was successfully and sufficiently reactivated to remove about ¾ of the iron.

The embodiments of the invention for which an exclusive property or privilege is claimed are defined as follows:

1. A process for treating a fluid stream of used fracturing fluid containing contaminants, including one or more of light hydrocarbons and water, for forming a reconditioned fluid stream, the process comprising:

distilling the fluid stream for removing the one or more of the light hydrocarbons and water so as to form a distilled fluid stream;

applying an electrostatic field to the distilled fluid stream for positively and negatively charging contaminants in the distilled fluid stream for forming a charged fluid stream;

retaining the charged fluid stream for agglomerating at least a portion of the charged contaminants for forming agglomerates therein; and filtering the charged fluid stream for removing at least the agglomerates for forming a filtered fluid stream as the reconditioned fluid stream.

2. The process of claim 1 wherein the distilling of the water of the fluid stream comprises heating the fluid stream and discharging the fluid stream into a vessel at a distillation pressure.

3. The process of claim 1 wherein the distilling of the fluid stream further comprises heating the fluid stream and discharging the fluid stream through a nozzle into a vessel at a distillation pressure.

4. The process of claim 3 wherein the discharging of the fluid stream through the nozzle creates droplets of the fluid stream.

5. The process of claim 4 further comprising forming the droplets of sufficient size to fall by gravity for recovery as the distilled fluid stream.

6. The process of claim 3 further comprising:

heating the fluid stream to between about 70° C. to about 80° C.; and discharging the fluid stream through a nozzle into the vessel at the distillation pressure of between about 5 psia to about 8 psia.

7. The process of claim 3 further comprising:

heating the fluid stream to about 120° C.; and discharging the fluid stream through a nozzle into the vessel at the distillation pressure of about atmospheric.

8. The process of claim 3 further comprising heating the fluid stream using a heat recovered from the filtered fluid stream or the reconditioned fluid stream.

9. The process of claim 1 wherein applying an electrostatic field to the distilled fluid stream further comprises:

separating the distilled fluid stream into a first portion and a second portion;

positively charging contaminants in the first portion of the distilled fluid stream;

negatively charging contaminants in the second portion of the distilled fluid stream; and combining the first and second portions of the distilled fluid stream for forming the charged fluid stream.

10. The process of claim 1 wherein applying an electrostatic field to the distilled fluid stream further comprises recirculating a batch of the fluid stream through the electro-static field for forming the charged fluid steam.

11. The process of claim 1 further comprising treating the filtered fluid stream through a clay tower for adsorbing residual contaminants contained therein for forming the reconditioned fluid stream.

12. The process of claim 11 wherein the residual contaminants comprise one or more of phosphorus, organometals and heavy hydrocarbons.

13. The process of claim 11 wherein the residual contaminants comprise volatile phosphorus.

14. The process of claim 11 further comprising periodically thermally reactivating the clay tower.

15. The process of claim 1 wherein, prior to distilling the fluid stream, further comprising storing the fluid stream and recovering a first decanted fluid stream for distilling.

16. The process of claim 1 wherein, after filtering the fluid stream, further comprising storing the filtered fluid stream and recovering the reconditioned fluid stream therefrom.

17. The process of claim 3 wherein the heating the fluids stream further comprises exchanging heat recovered from the reconditioned fluid stream.

18. The process of claim 1 wherein, when the used fracturing fluid is gelled, further comprising, prior to distilling the fluid stream, adding a breaker.

* * * * *